United States Patent [19]

Grewe

[11] Patent Number: 4,507,702

[45] Date of Patent: Mar. 26, 1985

[54] RELAY CONTROLLED LOAD

[75] Inventor: Gunter P. Grewe, Mississauga, Canada

[73] Assignee: Tervcon Limited, Ontario, Canada

[21] Appl. No.: 469,995

[22] Filed: Feb. 25, 1983

[30] Foreign Application Priority Data

Mar. 9, 1982 [CA] Canada ..... 397967

[51] Int. Cl.[3] ..... H01H 47/26; F23N 5/16

[52] U.S. Cl. ..... 361/161; 361/191; 307/117; 340/514; 340/577; 328/6; 431/78

[58] Field of Search ..... 361/161, 191, 192; 307/117; 340/514, 577; 328/6; 431/78

[56] References Cited

U.S. PATENT DOCUMENTS

| | | | |
|---|---|---|---|
| 2,829,229 | 4/1958 | Metz | 361/167 X |
| 3,594,746 | 6/1971 | Pileika | 340/214 |
| 3,825,913 | 7/1974 | Metcalf et al. | 340/515 |
| 3,827,040 | 7/1974 | Simmons | 361/191 X |
| 3,958,126 | 5/1976 | Bryant | 340/577 X |
| 3,995,221 | 11/1976 | MacDonald | 328/6 |
| 4,113,419 | 9/1978 | Cade | 431/78 |
| 4,157,506 | 6/1979 | Spencer | 328/6 |
| 4,157,580 | 6/1979 | Auer, Jr. et al. | 361/167 |
| 4,300,099 | 11/1981 | Maruyama | 328/6 |
| 4,322,723 | 3/1982 | Chase | 340/578 |
| 4,404,613 | 9/1983 | Channing et al. | 361/192 X |

*Primary Examiner*—A. D. Pellinen
*Assistant Examiner*—Derek Jennings
*Attorney, Agent, or Firm*—Cushman, Darby & Cushman

[57] ABSTRACT

There is provided a control unit for controlling the operation of a fuel valve. The control unit includes a first relay and a second relay. The first relay and the second relay are connectable in series and oppositely actuable. The first relay is actuable in response to a first control signal. The second relay is actuable in response to a second control signal which is inverted with respect to the first control signal. Thus, the relays are differentially operated. Further, there is disclosed a scanner control unit which reduces the noise of a voltage signal whose magnitude is representative of the intensity of a monitored flame in a boiler. The flame scanner control unit uses a comparator to reduce the noise in the voltage signal. The voltage signal is provided at one input of the comparator and a reference signal is provided at the other input of the comparator. The reference signal is representative of the intensity of noise in the boiler when the monitored flame is out.

7 Claims, 2 Drawing Figures

RELAY CONTROLLED LOAD

BACKGROUND OF THE INVENTION

1. Field of the Invention

The present invention relates to a control unit for controlling the operation of a load and to a flame scanner control unit for reducing the noise content of a voltage signal which is representative of the intensity of a monitored flame.

2. Description of the Prior Art

During the operation of industrial and utility boilers it is critical that the supply of fuel to the flame in the boiler be stopped when the flame goes out. Should the supply of fuel continue after the flame is out, there is a potential for a combustion explosion due to the flame re-igniting or other flames in the boiler igniting the excess fuel. There is also a potential for steam to build up within the boiler resulting in a steam explosion.

Flame scanning systems have been developed for the purpose of reducing the risk of explosions in boilers due to the flame going out. The flame scanning system commonly includes a scanner which monitors a flame in the boiler and provides a signal indicating whether or not the monitored flame is present. The flame scanning control system further includes a relay switch that is connected in series relation with the control circuitry of a fuel valve. In the event the flame scanner sees that the flame has gone out, the flame scanner sends a signal to the relay switch control causing the relay to open circuit or de-energize the fuel valve control circuitry. When the valve control circuitry de-energizes the fuel valve closes thereby impeding the flow of fuel to the boiler. The present relay switch utilized in a flame scanning system comprises a relay switch whose control circuitry is driven by a driving transistor. The driving transistor is responsive to a flame on signal received from the flame scanner.

One problem associated with the above flame scanning system occurs when the contacts of the relay switch weld and do not break the circuit controlling the operation of the fuel valve. Consequently there is a potential for an explosion in the boiler.

Another problem associated with the flame scanning system resides in the driving transistor used to control the operation of the relay. When the relay de-energizes, an excess amount of voltage may cause the transistor driver to fail in a short circuit mode. As a result, when the driving transistor receives a flame off signal from the flame scanner, the driving transistor cannot de-energize the relay to break the circuit controlling the fuel valve.

Another problem inherent in the present flame scanning system is the flame scanner may not be able to discriminate between the flame it is mohitoring and other flames in the boiler. Accordingly, the flame scanner may not provide the necessary signal when the monitored flame goes out. While the optics in the flame scanner have been adjusted to reduce the focus of the flame scanner to a small area, this is not satisfactory.

SUMMARY OF THE INVENTION

Accordingly it is a primary object of the present invention to provide a control unit where the possibility of the relays failing to de-energize the load control circuitry due to contact welding or sticking is reduced.

It is another object of the present invention to provide a control unit whose relays will de-energize the load control circuitry in the event of a relay driver failing.

It is a further object of the present invention to provide a flame scanner control unit that compensates for background noise provided in a boiler.

In accordance with one aspect of the present invention there is provided a control unit for controlling the operation of a load. The control unit includes a first relay means and a second relay means. The first and second relay means are connectable in series and are oppositely actuable. The first relay means is actuable in response to a first control signal. The second relay means is actuable in response to a second control signal which is inverted with respect to the first control signal. Accordingly, the first and second relays are differentially operated.

By differentially operating the relays an electrical path through the relays is only provided when one of the relays is energized and the other relay is de-energized. To switch the relays in and out of circuit with the load, the control unit de-energizes one of the relays while simultaneously energizing the other of the relays and vice versa. Thus during normal operation of the relays the electrical circuit path is maintained by one of the relays in its normally de-energized state and the other relay in its energized state. In the event of contact welding at least one of the relays is able to take advantage of its magnetizing or energizing forces to open the circuit to the load. As the magnetizing forces tend to be greater than the resulting force required to move the relay into its other state, there is less chance of the relay contacts welding in a manner that would allow continued energization of the load. Also, should one of the relay drivers fail in its short circuit mode and thereby continuously energize its corresponding relay, energization of the other relay will break the circuit.

In accordance with another aspect of the invention there is provided a flame scanner control unit which produces a voltage signal whose magnitude is representative of the intensity of a monitored flame in a boiler. The control unit includes the noise reducing means that is responsive to the voltage signal and a reference signal. The reference signal is representative of the intensity of noise in the boiler when the monitored flame is out. The noise reducing means in effect subtracts the reference signal from the voltage signal to eliminate background noise in the boiler. The background noise is monitored by the flame scanner regardless of the condition of the flame.

BRIEF DESCRIPTION OF THE DRAWINGS

For better understanding of the nature and objects of the present invention reference may be had by way of example to the accompanying diagrammatic drawings in which.

DESCRIPTION OF THE PREFERRED EMBODIMENTS

Figure 1:
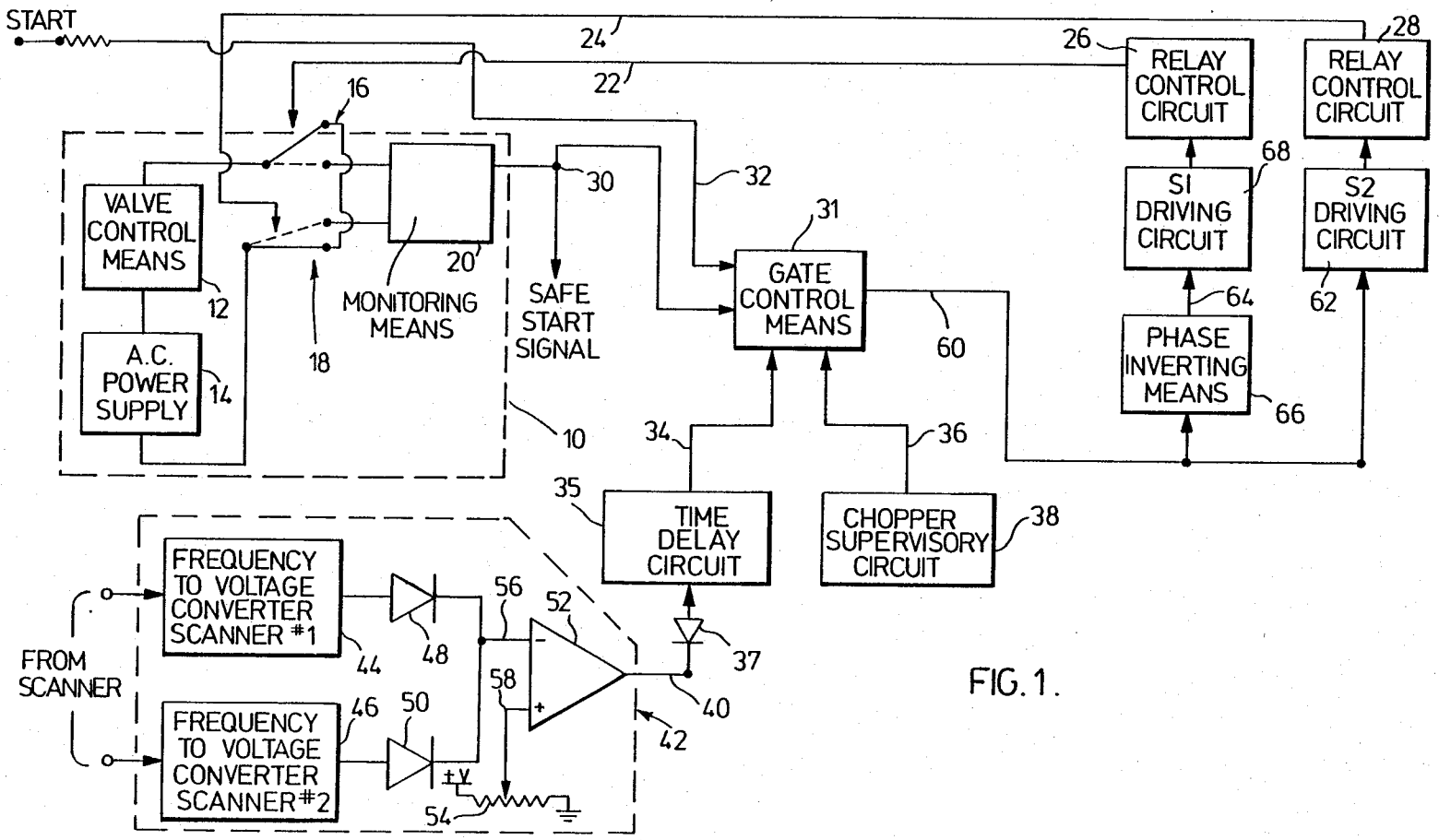
FIG. 1 is a schematic drawing showing a flame control unit.

Referring to FIG. 1, there is illustrated a portion of the flame control unit that controls the operation of a fuel valve which supplies fuel to a flame in a boiler (not shown). The flame scanner control unit receives a signal from a flame scanner which indicates whether the flame is on or off. In response to this information, the flame scanner control unit opens or closes the fuel valve supplying fuel to the flame in the boiler.

A control circuit for controlling the operation of the valve is shown generally within broken line 10. This circuit includes a valve control means 12, a power supply 14, a first relay means 16, a second relay means 18 and a monitoring means 20. The contacts of the relays 16 and 18 are moveable between a position shown by the solid line and a position shown by the broken line. When the relays 16 and 18 are in the position shown by the solid line, the valve control means 12 is energized and the valve is open. When the relays 16 and 18 are in the position shown by the broken line, the valve control means 12 is de-energized and the valve is closed impeding the flow of fuel to the flame. Movement of the relays between the position shown by the solid line and the position shown by the broken line is controlled by the presence of signals on lines 22 and 24 from the relay control circuits 26 and 28.

As illustrated, relays 16 and 18 are oppositely actuated. That is to say, when relay 18 moves from the position shown by the solid line to the position shown by the broken line, it is in effect being de-energized and the spring bias of the relay is moving the contacts back into the normally biased position. On the other hand, when relay 16 moves from the position shown by the solid line to the position shown by the broken line, the relay is energized by a control signal on line 22 and the force resulting from the energization of the relay causes the relay to move against its normally biasing forces. Accordingly, during a change in state of the relay switches one of the relays 16 and 18 will be de-energized while the other is energized. The relay energized will have available a greater force to overcome any resistance to the movement of the contact of the relay due to welding or sticking of the relay contact. The greater force is in effect the magnetic force as opposed to the lesser force of the retention spring.

The monitoring means 20 provides an output signal on line 30 when both relays 16 and 18 are in the position shown by the broken lines. The signal outputted on line 30 is a safe start signal which indicates that the relays are operating properly. This safe start signal is also sent to a gate control means 31. Gate control means 31 is also responsive to a start signal from line 32, a flame signal from line 34 and a chopper control signal from line 36. The presence of both start signal and the safe start signal on lines 32 and 30 permit the contacts to move from the position shown in the broken lines to the position shown in the solid lines when a flame on signal is present on line 34.

The chopper signal provided on line 36 comes from chopper supervisory circuitry 38. The purpose of chopper supervisory circuitry 38 is to provide an oscillating signal that is sent to the flame scanner so that the chopper in the flame scanner acts as a shutter impeding for a short predetermined time interval the travel of light to the scanner. The chopper supervisory circuit is provided as an additional safety measure to ensure that the scanner is functioning properly.

The flame signal provided on line 34 comes from a time delay circuit 35. Time delay circuit 35 has at its input an inverter 37 which inverts the flame signal on line 40. The time delay circuit provides a flame signal when the flame is on. The time delay circuit 36 further compensates for a temporary loss in the flame signal due to the chopper supervisory circuit 38 periodically impeding the light received by the scanner.

The flame signal on line 40 is provided at the output of the circuitry shown within the broken line 42. This circuitry includes two frequency to voltage converters 44 and 46, two rectifiers 48 and 50, a comparator or noise reducing means 52, and a variable resistor 54 connected between a positive voltage and ground. The frequency to voltage converters 44, 46 receive from two different scanners a signal whose frequency is varied as a function of the intensity of the flame monitored by the scanning unit. The frequency to voltage converters convert the frequency signal to a train of voltage pulses, the magnitude of which varies with the intensity of the flame monitored. The rectifiers 48 and 50 are arranged in such a fashion that only the largest signal is permitted to enter comparator 52 at its input 56. The other comparator input 58 is connected to the variable resistor 54. The variable resistance of resistor 54 is such that the voltage developed across resistor 54 is representative of the background noise in the boiler. The resistance value of variable resistor 54 is adjusted when the flame being monitored is turned off. Thus, the voltage at comparator input 58 is representative of the background noise and is the threshold voltage at which comparator 52 operates.

The operation of the gate control means 31 will be described in more detail later with the description of FIG. 2. However, when gate control means is satisfied that the inputs on lines 30, 32, 34 and 36 are proper, gate control means sends a control signal out along line 60. The control signal goes from line 60 to a first driving circuit 62 which drives the relay coil in the relay control circuitry 28. In effect control signal on line 60 acts to energize relay 18 through relay control circuitry 28 and driving circuitry 62. A second control signal is provided at line 64 by means of a phase inverting means 66 which inverts the control signal 60. The presence of a second control signal on line 64 at driving circuitry 68 will drive the relay control circuit 26 such that the coil of relay 16 is de-energized. By referring to the presence of a control signal, it is meant that a high logic level type of signal will be present. Accordingly, when a high logic level signal is present at the input of driving circuit 62 a low level logic signal will be present at the input of driving circuit 68. Thus during normal operation only one of the driving circuits and relay control circuits will be energizing its corresponding relay.

Figure 2:
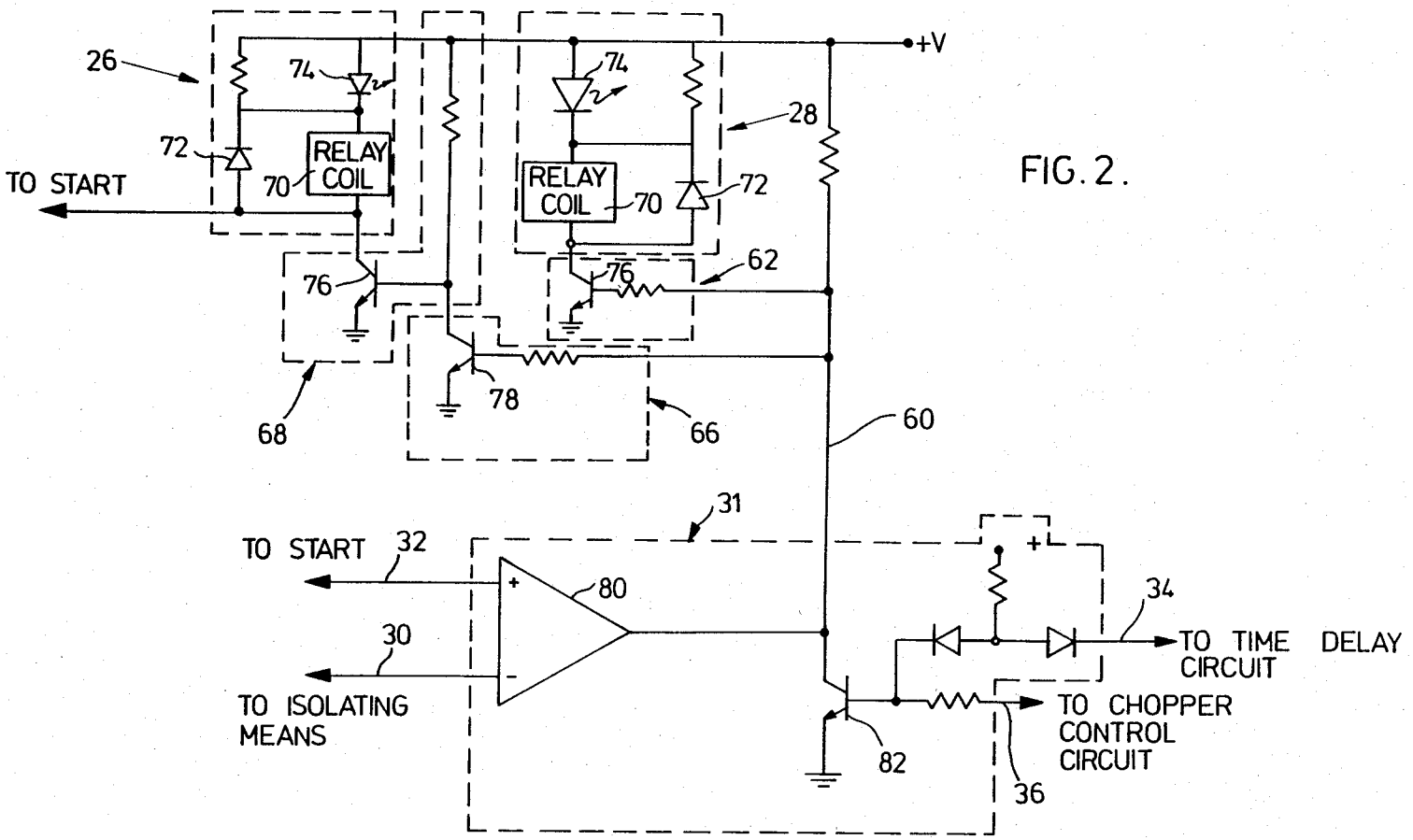
FIG. 2 is a detailed circuit diagram for some of the circuitry referred to in FIG. 1.

Referring to FIG. 2 each of the relay control circuits 26 and 28 is shown to comprise a relay coil 70 having a limiting diode 72 connected across the coil 70. The limiting diode 72 absorbs any peak voltages when the relay coil 70 de-energizes. Immediately above each relay coil is a light emitting diode 74. The light emitting diode 74 gives a visual indication whether or not the relay coil is energized.

Shown connected immediately below each relay coil 70 is a transistor 76. Each of the driving circuits 62 and 68 in effect comprises a transistor 76. The inverting means 66 is also shown to comprise the transistor 78. The base of transistor 76 of driving circuit 66 is connected to the collector of transistor 78 of inverting means 64. The base of transistor 78 of inverting means 66 and base of transistor 76 of driving means 62 are connected to the control signal line 60.

The gating means 31 comprises a comparator 80 and a transistor 82. The comparator compares the signal from the monitoring means on line 30 with an enable signal from the start device on line 32. Should the monitoring means signal on line 30 not be present, then the output of the comparator 80 causes line 60 to go "low" thereby causing transistor 76 of driving means 62 and transistor 78 of inverter means 66 to be non-conducting. In this event, transistor 76 of driving means 68 conducts thereby energizing coil 70 of relay 16. In the event that the monitoring means has a signal on line 30, indicating that the contacts of relay 16 and 18 are functioning properly, the presence of the start signal on line 32 will allow the comparator to hold line 60 high. As a result the operation of the inverting means 66 and the two driving means 62 and 68 is controlled by transistor 82. Transistor 82 functions as an AND gate. It has two inputs, one from line 36 of the chopper supervisory circuit and the other from line 34 of the time delay circuit. The base of transistor 82 is held high by the voltage supply V+. Consequently, transistor 82 conducts and line 60 goes low. Upon the presence of a low signal at the base of transistor 82, transistor 82 will not conduct and line 60 goes high. The base of transistor 82 is low when either a signal from the time delay circuit or the chopper supervisory circuit is present respectively indicating the flame is off or the chopper has malfunctioned.

I claim:

1. A control unit for controlling operation of a load comprising:

a first relay means and a second relay means;

said first and second relay means being connectable in series and oppositely actuable;

said first relay means actuable in response to a first control signal;

said second relay means actuable in response to a second control signal which is inverted with respect to said first control signal whereby the relays are differentially operated;

monitoring means providing an enable signal when said relay means are able to be connected in series, said first and second control signals capable of being generated only when said enable signal is provided by said monitoring means.

2. The control unit of claim 1 further including a first driving means responsive to said first control signal for actuating said first relay means and a second driving means responsive to said second control signal for actuating said second relay means.

3. The control unit of claim: 2 further including an inverting means for inverting said first control signal.

4. The control unit of claim 2 wherein the series connection of said first and second relay means is broken upon a failure of one of said driving means.

5. The control unit of claim 2 wherein each of the driving means comprises a solid state switching device.

6. A control unit for controlling operation of a load comprising:

a first relay means and a second relay means being oppositely actuable, said first relay means including a first relay coil and first relay contacts movable between a first position when the first relay coil is energized and a second position when the first relay coil is de-energized; said second relay means including a second relay coil and second relay contacts movable between a first position when the second relay coil is de-energized and a second position when said second relay coil is energized; the first and second contacts being connectable in series when each is in its first position to permit operation of said load;

drive means for energizing said first relay coil in response to a first control signal and for de-energizing said second relay coil in response to a second control signal which is inverted with respect to said first control signal, whereby the relays are differentially operated; and operation of said load being prevented in the event either one of the first and second relay contacts moves into its second position whereby continued load operation due to one of relay contact welding and drive means failure is minimized.

7. The control unit of claim 6 further including monitoring means which provides an enable signal when the first and second relay contacts are both in their second position, said first and second control signals capable of being generated only when said enable signal is provided by said monitoring means.

* * * * *